US009751710B2

(12) United States Patent
Newhouse et al.

(10) Patent No.: US 9,751,710 B2
(45) Date of Patent: Sep. 5, 2017

(54) ADAPTABLE WEB SPREADING DEVICE

(71) Applicant: 3M INNOVATIVE PROPERTIES COMPANY, St. Paul, MN (US)

(72) Inventors: Kevin B. Newhouse, Houlton, WI (US); Bruce E. Tait, Woodbury, MN (US); Onyinye Chiejina, Simpsonville, SC (US)

(73) Assignee: 3M Innovative Properties Company, St. Paul, MN (US)

( * ) Notice: Subject to any disclaimer, the term of this patent is extended or adjusted under 35 U.S.C. 154(b) by 15 days.

(21) Appl. No.: 14/421,242

(22) PCT Filed: Aug. 26, 2013

(86) PCT No.: PCT/US2013/056553

§ 371 (c)(1),
(2) Date: Feb. 12, 2015

(87) PCT Pub. No.: WO2014/035850

PCT Pub. Date: Mar. 6, 2014

(65) Prior Publication Data

US 2015/0217960 A1 Aug. 6, 2015

Related U.S. Application Data

(60) Provisional application No. 61/694,300, filed on Aug. 29, 2012.

(51) Int. Cl.
*B65H 27/00* (2006.01)
*B65H 23/025* (2006.01)

(52) U.S. Cl.
CPC ..... *B65H 27/00* (2013.01); *B65H 23/0251* (2013.01); *B65H 2404/114* (2013.01);
(Continued)

(58) Field of Classification Search
CPC .. B65H 20/02; B65H 23/025; B65H 23/0251; B65H 2404/1313; B65H 2404/1316;
(Continued)

(56) References Cited

U.S. PATENT DOCUMENTS 1,875,257 A 8/1932 Nylund
3,622,412 A * 11/1971 Ross ..... B41N 10/02 156/87

(Continued)

FOREIGN PATENT DOCUMENTS

DE 1625615 1/1971
DE 102010022781 12/2011

(Continued)

OTHER PUBLICATIONS

Machine translation of DE 10 2010 022781 A1, retrieved May 12, 2016.*

(Continued)

*Primary Examiner* — Michael McCullough
(74) *Attorney, Agent, or Firm* — Robert H. Jordan

(57) ABSTRACT

The present disclosure describes a spreader roll (101) that can help spread webs laterally in a web processing operation, in particular to reduce or remove the presence of wrinkles or bagginess in the web. The spreader roll can be a reverse crown roll that is covered with a resilient material (160) to assist spreading the web to remove wrinkles. The surface curvature of the spreader roll (101) can be formed using layers of material such as a tape, to easily and readily approximate the shape of a reverse crown roll.

36 Claims, 5 Drawing Sheets

(52) U.S. Cl.
CPC ..... *B65H 2404/1141* (2013.01); *B65H 2404/1313* (2013.01); *B65H 2404/1316* (2013.01)

(58) Field of Classification Search
CPC ..... B65H 2404/114; B65H 2404/1141; B65H 231/5124; B65H 2301/5124; B65H 27/00
USPC ..... 492/27, 49–56
See application file for complete search history.

(56) References Cited

U.S. PATENT DOCUMENTS

| | | | | |
|---|---|---|---|---|
| 4,026,487 | A | 5/1977 | Ales, Jr. | |
| 4,368,568 | A * | 1/1983 | Watanabe | B29D 99/0035 492/52 |
| 6,120,864 | A | 9/2000 | Chiricosta | |
| 2012/0157275 | A1 | 6/2012 | Peters | |

FOREIGN PATENT DOCUMENTS

| | | | |
|---|---|---|---|
| JP | 59-198238 | 11/1984 | |
| JP | 2004-331284 | 11/2004 | |
| JP | 2007-24967 | 2/2007 | |
| WO | WO 2011-038279 | 3/2011 | |
| WO | WO 2011-038284 | 3/2011 | |
| WO | WO 2011038284 A1 * | 3/2011 | B65H 27/00 |

OTHER PUBLICATIONS

International Search Report for PCT International Application No. PCT/US2013/056553 mailed on Jan. 13, 2014, 5 pages.
"WINertia AV Reverse Crown Spreader", Componex, www.componex.net, Dec. 31, 2011, 2 pp.

* cited by examiner

ADAPTABLE WEB SPREADING DEVICE

CROSS REFERENCE TO RELATED APPLICATIONS

This application is a national stage filing under 35 U.S.C. 371 of PCT/US2013/056553, filed Aug. 26, 2013, which claims priority to U.S. Provisional Application No. 61/694,300, filed Aug. 29, 2012, the disclosure of which is incorporated by reference in its/their entirety herein.

BACKGROUND

Many products are often manufactured in a continuous web format for the processing efficiencies and capabilities that can be achieved with that approach. The term "web" is used here to describe thin materials which are manufactured or processed in continuous, flexible strip form. Illustrative examples include thin plastics, paper, textiles, metals, and composites of such materials.

Such operations typically entail use of one or more, frequently many more, rollers (sometimes referred to as rolls) around which the web is conveyed throughout the process through a series of treatments, manufacturing steps, etc. Rollers are used for many purposes, including, for example, turning the direction of the web, applying pressure to the web in nip stations, positioning the web for travel through coating and other treatment stations, positioning multiple webs for lamination, stretching webs, etc. Rollers used in such operations are made of a variety of materials, with the selection dependent in large part upon the web(s) being handled, the operational parameters (for example, speed, temperature, humidity, tension, etc.). Some illustrative examples of materials used to make rollers or covering surfaces thereon include rubber, plastics, metal (for example, aluminum, steel, tungsten, etc.), foam, felt, knitted fabrics, and woven fabrics. Specific rollers may be configured to be free rolling, powered (in the same direction the web is traveling or opposite direction, at the same or different speed than the web is traveling, etc.), etc. depending upon the desired tension parameters.

New generation products entail ever more rigorous and precise specifications. Ever more stringent quality control specifications require higher performing processes. Manufacturers using web handling seemingly continually seek higher web processing speeds. The need exists for improved web transport and web handling methods and apparatuses, particularly for use in the high speed, high capacity manufacture and handling of demanding web materials such as optical films and other specialty plastic materials.

SUMMARY

The present disclosure describes a spreader roll that can help spread webs laterally in a web processing operation, in particular to reduce or remove the presence of wrinkles or bagginess in the web. The spreader roll can be a reverse crown roll that is covered with a resilient material to assist spreading the web to remove wrinkles. The surface curvature of the spreader roll can be formed using layers of material such as a tape, to easily and readily approximate the shape of a reverse crown roll. In one aspect, the present disclosure provides a spreader roll that includes a reverse crown roll having a major surface, two ends, a midpoint halfway between the two ends, and a variable diameter that decreases from a first end diameter to a midpoint diameter, and increases from the midpoint diameter to a second end diameter; and an engagement cover comprising a resilient engagement surface, the engagement cover disposed over the major surface of the reverse crown roll. In one particular embodiment, the major surface is a stepped major surface, and the variable diameter decreases stepwise from the first end diameter to the midpoint and increases stepwise from the midpoint to the second end diameter. In another particular embodiment, the major surface is a stepped major surface that includes successive material layers of a tape, a sheet, a cord, a string, a wire, or a combination thereof.

In another aspect, the present disclosure provides a spreader roll that includes a reverse crown roll including a roller having an outer surface, a first end and a second end, a midpoint having a midpoint diameter midway between the first end and the second end, and a variable outer diameter and a first material layer attached to the outer surface and extending in opposing directions from a first distance from the midpoint to the first end and from a second distance from the midpoint to the second end. The reverse crown roll further includes a second material layer attached to the first material layer and extending in opposing directions from a third distance from the midpoint to the first end, and from a fourth distance from the midpoint to the second end, wherein the third distance is greater than the first distance, and the fourth distance is greater than the second distance. The spreader roll further includes an engagement cover comprising a resilient engagement surface, the engagement cover disposed over the outer surface, the first material layer, and the second material layer.

In yet another aspect, the present disclosure provides an apparatus for spreading a web that includes a spreader roll that includes a reverse crown roll having a major surface, two ends, a midpoint halfway between the two ends, and a variable diameter that decreases from a first end diameter to a midpoint diameter, and increases from the midpoint diameter to a second end diameter; and an engagement cover comprising a resilient engagement surface, the engagement cover disposed over the major surface of the reverse crown roll. In one particular embodiment, the major surface is a stepped major surface, and the variable diameter decreases stepwise from the first end diameter to the midpoint and increases stepwise from the midpoint to the second end diameter. In another particular embodiment, the major surface is a stepped major surface that includes successive material layers of a tape, a sheet, a cord, a string, a wire, or a combination thereof. The spreader roll being capable of rotating around an axis of rotation; wherein the spreader roll is capable of spreading a web material in a cross-web direction essentially parallel to the axis of rotation while conveying the web material in a downweb direction perpendicular to the spreader roll axis of rotation.

In yet another aspect, the present disclosure provides an apparatus for spreading a web that includes a spreader roll that includes a reverse crown roll including a roller having an outer surface, a first end and a second end, a midpoint having a midpoint diameter midway between the first end and the second end, and a variable outer diameter and a first material layer attached to the outer surface and extending in opposing directions from a first distance from the midpoint to the first end and from a second distance from the midpoint to the second end. The reverse crown roll further includes a second material layer attached to the first material layer and extending in opposing directions from a third distance from the midpoint to the first end, and from a fourth distance from the midpoint to the second end, wherein the third distance is greater than the first distance, and the fourth distance is greater than the second distance. The spreader roll further includes an engagement cover comprising a resilient engagement surface, the engagement cover disposed over the outer surface, the first material layer, and the second material layer. The spreader roll being capable of rotating around an axis of rotation; wherein the spreader roll is capable of spreading a web material in a cross-web direction essentially parallel to the axis of rotation while conveying the web material in a downweb direction perpendicular to the spreader roll axis of rotation.

In yet another aspect, the present disclosure provides a method for spreading a web that includes providing a spreader roll that includes a reverse crown roll having a major surface, two ends, a midpoint halfway between the two ends, and a variable diameter that decreases from a first end diameter to a midpoint diameter, and increases from the midpoint diameter to a second end diameter; and an engagement cover comprising a resilient engagement surface, the engagement cover disposed over the major surface of the reverse crown roll. In one particular embodiment, the major surface is a stepped major surface, and the variable diameter decreases stepwise from the first end diameter to the midpoint and increases stepwise from the midpoint to the second end diameter. In another particular embodiment, the major surface is a stepped major surface that includes successive material layers of a tape, a sheet, a cord, a string, a wire, or a combination thereof. The spreader roll being capable of rotating around an axis of rotation; providing a web material; conveying the web material in a downweb direction perpendicular to the axis of rotation; and contacting the moving web material with the engagement surface of the rotatable spreader roll, thereby spreading the web material in a crossweb direction essentially parallel to the axis of rotation.

In yet another aspect, the present disclosure provides a method for spreading a web that includes providing a spreader roll that includes a reverse crown roll including a roller having an outer surface, a first end and a second end, a midpoint having a midpoint diameter midway between the first end and the second end, and a variable outer diameter and a first material layer attached to the outer surface and extending in opposing directions from a first distance from the midpoint to the first end and from a second distance from the midpoint to the second end. The reverse crown roll further includes a second material layer attached to the first material layer and extending in opposing directions from a third distance from the midpoint to the first end, and from a fourth distance from the midpoint to the second end, wherein the third distance is greater than the first distance, and the fourth distance is greater than the second distance. The spreader roll further includes an engagement cover comprising a resilient engagement surface, the engagement cover disposed over the outer surface, the first material layer, and the second material layer. The spreader roll being capable of rotating around an axis of rotation; providing a web material; conveying the web material in a downweb direction perpendicular to the axis of rotation; and contacting the moving web material with the engagement surface of the rotatable spreader roll, thereby spreading the web material in a crossweb direction essentially parallel to the axis of rotation.

The above summary is not intended to describe each disclosed embodiment or every implementation of the present disclosure. The figures and the detailed description below more particularly exemplify illustrative embodiments.

BRIEF DESCRIPTION OF THE DRAWINGS

Throughout the specification reference is made to the appended drawings, where like reference numerals designate like elements, and wherein.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

Figure 1A:
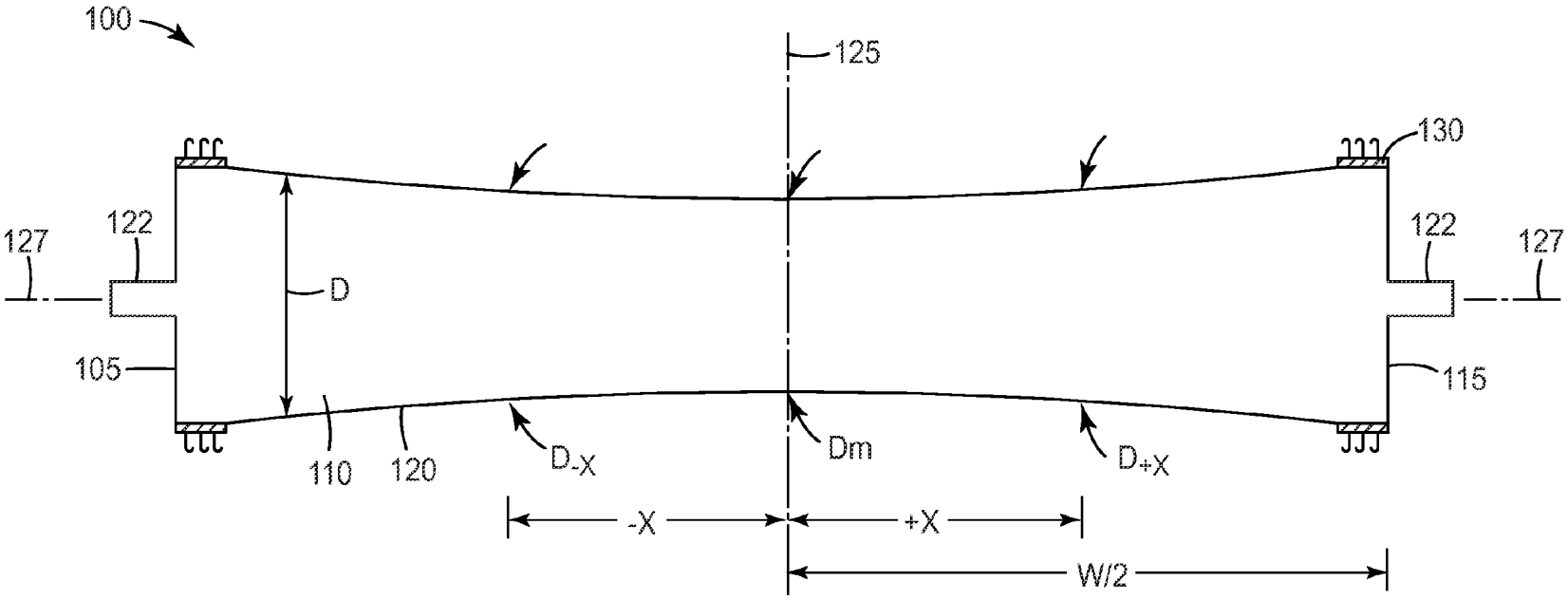
FIG. 1A shows a cross sectional view of a spreader roll.

The present disclosure describes a novel spreader roll that can help spread webs laterally in a web processing operation, in particular to reduce or remove the presence of wrinkles or bagginess in the web. The spreader roll can be a reverse crown roll that is covered with a resilient material to assist spreading the web to remove wrinkles. The surface curvature of the spreader roll can be formed using layers of material such as a tape, to easily and readily approximate the shape of a reverse crown roll. The resulting reverse crown roll covered with a resilient material is a low cost method to achieve web spreading and can be used on most any cylindrical roll. In some cases, one of the benefits with using resilient materials on such fabricated reverse crown rolls is that the web centering requirement can be relaxed from the precise centering typically required when using a reverse crown roll without resilient material.

Thin film web materials can develop wrinkles during production or converting operations, and efforts to control or reduce this wrinkling often use spreader rolls to provide lateral tension to the web, thereby smoothing the wrinkles Commonly available spreader rolls include bowed rollers, expanding surface rollers, rubber spreader rollers, grooved metal rollers, and reverse taper rollers. Reverse taper rollers (also commonly referred to as concave rolls, reverse crown rolls, or bow toe rolls) can be a preferred roll architecture to achieve effective web spreading. In many cases, the particular taper profile that may be most effective can vary depending on such parameters as the type of web material, web thickness, web speed and tension, and the web width being processed. For at least this reason, several different reverse taper rolls may need to be available to web-goods manufacturers or converters, which can lead to excessive costs.

Manufacturing thinner and more precise films requires greater and more precise control, such that defects including wrinkling and troughing during transport of the web over rollers are reduced. This becomes especially significant when optical quality web has any type of bagginess or skew. The variety of methods described above can work reasonably well when the web centerline or the web width does not vary significantly from product to product. However, since typical manufacturers or converters products can change web centerlines and widths, significant effort can be needed, such as the need to constantly adjust roll position or rebumper (for example, apply thicknesses of tape to) the rolls.

The present disclosure provides for a spreader roll that enables weblines to run thinner films without causing wrinkle damage to the web via use of such spreader rolls at various roll locations throughout the line. The disclosed spreader rolls can also be used just before a coater to help spread the web to reduce the amount of coating skip defects and can also be used to spread the web before a slitter to help reduce slitting debris. The novel spreader rollers can be used on almost any webline where there is a problem with web spreading when the web centerline and width is constantly changing, and can also be used on rolls where the winding is oscillating and causing the centerline to change.

A resilient material can be used as a resilient engagement surface to provide for spreading to a web that contacts the engagement surface. The resilient engagement surface can cover a reverse crown roll or a roll which has been built up to approximate a reverse crown roll by using layers of a tape, a sheet, a cord, a string, a wire, or a combination thereof to take the shape of a reverse crown roll. In one particular embodiment, a vinyl or similar type tape can be preferred to build up the shape of a reverse crown roll. The resilient material can be a resilient looped pile, an open cell foam, a closed cell foam, or a combination thereof. In one particular embodiment, the resilient material can be a knit fabric comprising a base layer having first and second faces and a resilient looped pile protruding from the first face.

The following terms are used herein as having the indicated meaning; other terms are defined elsewhere in the specification.

"Convey" is used to mean moving a web from a first position to a second position wherein the web passes through engaging contact with a roller.

"Engaging contact" is used to refer to contact between the web and the roller such that as the web is conveyed it engages with the engagement cover of the roller compressing the cover in response to contact with the web.

"Engagement surface" is the radially outwardly facing portion of the engagement cover that is directly contacted with the web when the web is conveyed.

"Engagement zone" is the portion of the engagement surface that is in direct contact with the web at a particular moment.

"Resilient" is used to refer to the capability of being deformed or compressed and then recovering to earlier shape or loft.

"Web" refers to a flexible, elongate ribbon or sheet of material.

In the following description, reference is made to the accompanying drawings that forms a part hereof and in which are shown by way of illustration. It is to be understood that other embodiments are contemplated and may be made without departing from the scope or spirit of the present disclosure. The following detailed description, therefore, is not to be taken in a limiting sense.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

As used in this specification and the appended claims, the singular forms "a," "an," and "the" encompass embodiments having plural referents, unless the content clearly dictates otherwise. As used in this specification and the appended claims, the term "or" is generally employed in its sense including "and/or" unless the content clearly dictates otherwise.

Spatially related terms, including but not limited to, "lower," "upper," "beneath," "below," "above," and "on top," if used herein, are utilized for ease of description to describe spatial relationships of an element(s) to another. Such spatially related terms encompass different orientations of the device in use or operation in addition to the particular orientations depicted in the figures and described herein. For example, if an object depicted in the figures is turned over or flipped over, portions previously described as below or beneath other elements would then be above those other elements.

As used herein, when an element, component or layer for example is described as forming a "coincident interface" with, or being "on" "connected to," "coupled with" or "in contact with" another element, component or layer, it can be directly on, directly connected to, directly coupled with, in direct contact with, or intervening elements, components or layers may be on, connected, coupled or in contact with the particular element, component or layer, for example. When an element, component or layer for example is referred to as being "directly on," "directly connected to," "directly coupled with," or "directly in contact with" another element, there are no intervening elements, components or layers for example.

The web material will typically be provided in roll form, for example, wound upon itself or on a core, but may be provided in other configuration if desired. The present disclosure may be used with a wide variety of web materials, illustrative examples including plastics, paper, metal, and composite films or foils.

In some embodiments, the web material is provided from an intermediate storage state, for example, from an inventory of raw materials and/or intermediate materials. In other embodiments, the web material may be provided to the process of the present disclosure directly from precursor processing, for example, such as the take off feed from a film forming process. The web material may be single layer or multilayer, in some instances the described invention is used to convey the web material through manufacturing operations in one or more additional layers and/or one or more treatments are applied to a web material.

Configuring the web material into passing configuration simply refers to arranging the web material into position and orientation such that it can be put into engaging contact with the engagement surface of a roller in accordance with the disclosure. In many embodiments, this will simply comprise unrolling a portion of the web material which is in roll form such that it can be put into engaging contact with the engagement surface. In other illustrative embodiments, the web material is formed in a precursor portion of the operation, that is, in line, and passed directly into a web conveying apparatus without having been wound into roll form, for example, the polymeric material is extruded or cast in line to form a film which, at that point is in passing configuration without ever having been wound into roll form, is the web material conveyed by the apparatus of the disclosure.

FIG. 1A shows a cross sectional view of a spreader roll 100 that can be a reverse crown roll 110, according to one aspect of the invention. Reverse crown roll 110 includes a major surface 120, a first end 105, an opposing second end 115, a central shaft 122 and an axis of rotation 127 about which the reverse crown roll 110 rotates. An optional attachment surface 130, for example a hooked material such as a 3M Scotchmate™ Hook and Loop Reclosable Fastener material may be included near the first and second ends 105, 115, for subsequent attachment of a resilient engagement surface, as described elsewhere.

The reverse crown roll 110 has a midpoint 125 halfway between the first and second ends 105, 115, a half-width "W/2", and a variable diameter "D" that decreases from the first end 105 to a midpoint diameter "Dm" and increases again from the midpoint diameter "Dm" to the second end 115. In some cases, the midpoint diameter "Dm" may be uniform for a portion of the half-width "W/2", and then increase. In some cases, the diameter at a distance (+/−X) from the midpoint 125 ("D+x" and "D−x", respectively) may be the same, that is, the roll can be symmetric about the midpoint 125, although in some cases, the roll may be asymmetric, and the diameters may be different. The change in the variable diameter "D" is exaggerated in FIG. 1A; typical variations in the diameter over a half-width "W/2" may be about 0.001" per inch of roller width, such that for a 6 foot (183 cm) half-width roller, the taper may be about 0.07" (1.78 mm), although in some cases the variation may be more. In one particular embodiment, the variation in the diameter may be greater when used with an engagement cover having a resilient engagement surface, as described elsewhere.

Figure 1B:
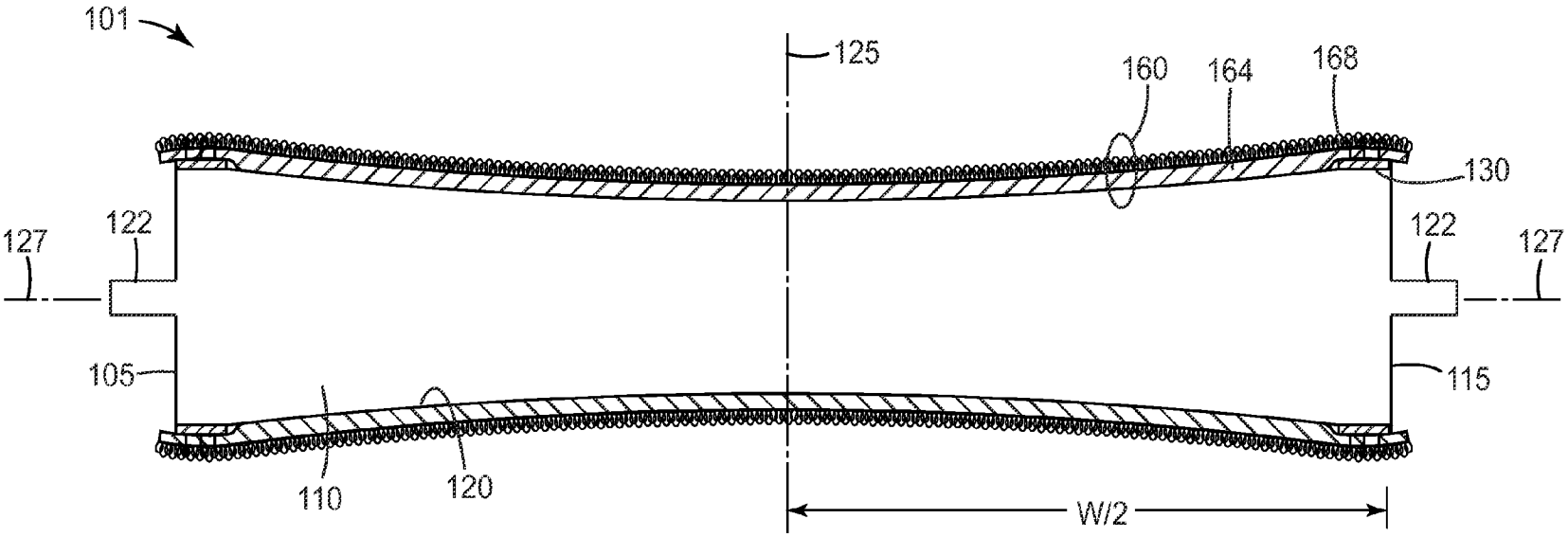
FIG. 1B shows a cross sectional view of a spreader roll.

FIG. 1B shows a cross sectional view of a spreader roll 101 that includes the reverse crown roll 110 of FIG. 1A, according to one aspect of the invention. Each of the elements 105-130 shown in FIG. 1B correspond to like-numbered elements shown in FIG. 1A, which have been described previously. For example, central shaft 122 in FIG. 1B corresponds to central shaft 122 in FIG. 1A, and so on. In FIG. 1B, the reverse crown roll 110 is covered by disposing an engagement cover 160 comprising a resilient engagement surface, over the major surface 120 of the reverse crown roll 110. In some cases, the resilient engagement surface comprises a resilient looped pile, an open cell foam, a closed cell foam, or a combination thereof. In one particular embodiment, the engagement cover 160 includes a resilient engagement surface that is a knit fabric having a base layer 164 having a resilient looped pile 168 protruding from the base layer 164. In the embodiment shown in FIG. 1B, engagement cover 160 is removable from the reverse crown roll 110 and comprises base layer 164 and resilient looped pile 168 extending upwardly from the first face thereof to form the resilient engagement surface. The second face of base layer 164 is in contact with the major surface 120 of the reverse crown roll 110.

Figure 2A:
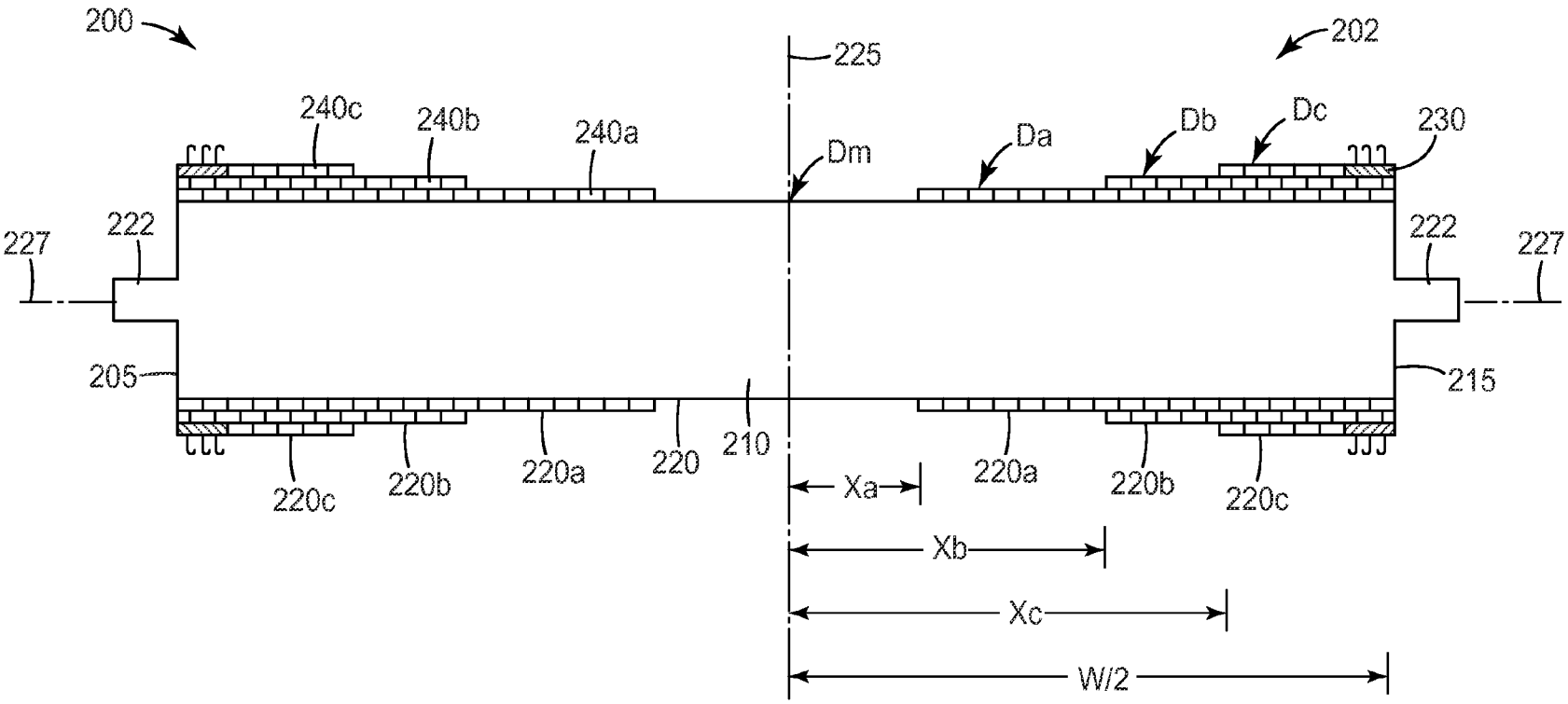
FIG. 2A shows a cross sectional view of a stepped reverse crown roll.

FIG. 2A shows a cross sectional view of a stepped reverse crown roll 200 that can be used as a spreader roll or a component of a spreader roll, according to one aspect of the invention. Stepped reverse crown roll 200 includes a base roll 210 having a base major surface 220, a first end 205, an opposing second end 215, a central shaft 222 and an axis of rotation 227 about which the base roll 210 rotates. An optional attachment surface 230, for example a hooked material such as a 3M Scotchmate™ Hook and Loop Reclosable Fastener material may be included near the first and second ends 205, 215, for subsequent attachment of a resilient engagement surface, as described elsewhere. In some cases, the optional attachment surface 230 can be included over the stepped material layers as described below and shown in FIG. 2A; however, the optional attachment surface 230 can instead be applied directly to the base major surface 220 of the base roll 210.

The base roll 210 has a midpoint 225 halfway between the first and second ends 205, 215, a half-width "W/2", and a variable diameter "D" that decreases from the first end 205 to a midpoint diameter "Dm" and increases again from the midpoint diameter "Dm" to the second end 215. In some cases, the midpoint diameter "Dm" may be a uniform diameter throughout the half-width "W/2", in which case the base roll 210 is a cylindrical roller. In some cases, the midpoint diameter "Dm" may be uniform for a portion of the half-width "W/2", for example to a first distance "Xa" from the midpoint 225, and then increase to the first and second end 205, 215. In some cases, the midpoint diameter "Dm" may steadily increase from the midpoint 225 to the first and second ends 205, 215, such as in the reverse crown roll 110 described with reference to FIG. 1A. In one particular embodiment, the cylindrical base roll 210 can be preferred, where the midpoint diameter "Dm" does not vary from the first end 205 to the second end 215.

Stepped reverse crown roll 200 includes a stepped major surface 202 that has a variable diameter that decreases stepwise from the first end 205 to the midpoint 225, and increases stepwise from the midpoint 225 to the second end 215. The stepwise changes in diameter can be inexpensive and rapid approximations to a machined reverse crown roll, such as the reverse crown roll 110 shown in FIG. 1A. The changes in the diameter can be made by applying successive first material layers such as first layer 220*a*, second layer 220*b*, and third layer 220*c*, to the base major surface 220 of base roll 210. It is to be understood that any desired number of first material layers can be applied to achieve the desired number of stepwise changes in the diameter. Each of the successive first, second, and third layers 220*a*, 220*b*, 220*c*, can comprise individual sections of first materials 240*a*, 240*b*, 240*c* that can individually be selected from a tape, a sheet, a cord, a string, a wire, or the like, or a combination thereof. In one particular embodiment, a tape, such as an adhesive vinyl tape, can be preferred.

In one particular embodiment, each of the successive first, second, and third layers 220*a*, 220*b*, 220*c* can be spirally wound around the base roll 210, and in some cases adjacent spirally wound first material layers abut each other. In some cases, the adjacent spirally wound first material layers can abut each other such that no space remains between adjacent layers; however, in some cases, a space can remain between adjacent spirally wound first material layers. In one particular embodiment, each of the successive first, second, and third layers 220*a*, 220*b*, 220*c* comprises a sheet that is circumferentially wound around the base roll 210.

First layer 220*a* extends from the first distance "Xa" from the midpoint 225 to a second distance "Xb" from the midpoint 225, and results in a first stepped diameter "Da". Second layer 220*b* extends from the second distance "Xb" from the midpoint 225 to a third distance "Xc" from the midpoint 225, and results in a second stepped diameter "Db". Third layer 220*c* extends from the third distance "Xc" from the midpoint 225 to the half-width "W/2" from the midpoint 225, and results in a third stepped diameter "Dc". In this manner, the stepped major surface 202 of stepped reverse crown roll 200 can approximate the major surface 120 of the reverse crown roll 110 shown in FIG. 1A, by comprising the midpoint diameter "Dm", the first stepped diameter "Da", the second stepped diameter "Db", and the third stepped diameter "Dc".

In some cases, the first, second, and third distances "Xa", "Xb", and "Xc", respectively, and any subsequent distances corresponding to additional layers (not shown) can be related as multiples of each other, or they may be spaced in some other manner, such as corresponding to any desired stepped profile that can aid in spreading the material to be processed. In some cases, each of the distances may be equally spaced, such that for example, (Xc−Xb)=(Xb−Xa), and so on. Further, in some embodiments, each of the first, second, and third diameters Da, Db, and Dc, respectively, and any subsequent diameters corresponding to additional layers (not shown) may also increase by a constant amount or may increase by differing amounts such as corresponding to any desired stepped profile that can aid in spreading the material to be processed. The different diameters can result from more than one layer of material or by different thicknesses of material being added to form each layer. In one particular embodiment, a single layer of vinyl-backed adhesive tape can be used to form each of the layers. In some cases, the thickness of the single layer of vinyl-backed adhesive tape can be the same for each of the layers; in other cases, the thickness of each single layer of vinyl-backed adhesive tape can be different for at least one of the layers.

In some cases, the stepped reverse crown roll 200 can be symmetric about the midpoint 225, although in some cases, the roll may be asymmetric, and the stepped diameters may be different on each side of the midpoint, as known by one of skill in the art. The change in the stepped diameter is exaggerated in FIG. 2A; typical variations in the diameter over a half-width "W/2" may be about 0.001" per inch of roller width, such that for a 6 foot (183 cm) half-width roller, the taper may be about 0.07" (1.78 mm), although in some cases the variation may be more. In one particular embodiment, each first material layer has a thickness between about 0.025 mm and about 0.25 mm. In one particular embodiment, the variation in the diameter may be greater when used with an engagement cover having a resilient engagement surface, as described elsewhere.

Figure 2B:
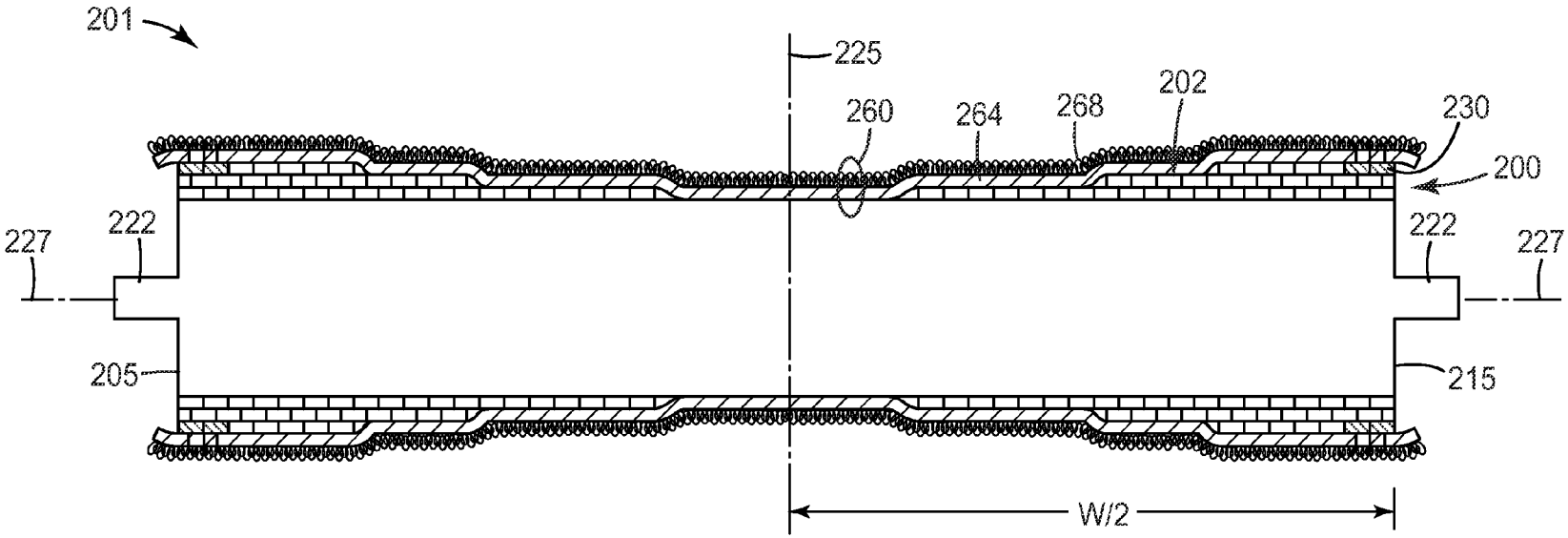
FIG. 2B shows a cross sectional view of a stepped spreader roll.

FIG. 2B shows a cross sectional view of a spreader roll 201 that includes the stepped reverse crown roll 200 of FIG. 2A, according to one aspect of the invention. Each of the elements 205-230 shown in FIG. 2B correspond to like-numbered elements shown in FIG. 2A, which have been described previously. For example, central shaft 222 in FIG. 2B corresponds to central shaft 222 in FIG. 2A, and so on. In FIG. 2B, the stepped reverse crown roll 200 is covered by disposing an engagement cover 260 comprising a resilient engagement surface, over the stepped major surface 202 of the stepped reverse crown roll 200. In some cases, the resilient engagement surface comprises a resilient looped pile, an open cell foam, a closed cell foam, or a combination thereof. In one particular embodiment, the engagement cover 260 includes a resilient engagement surface that is a knit fabric having a base layer 264 having a resilient looped pile 268 protruding from the base layer 264. In the embodiment shown in FIG. 2B, engagement cover 260 is removable from the stepped reverse crown roll 200 and comprises base layer 264 and resilient looped pile 268 extending upwardly from the first face thereof to form the resilient engagement surface. The second face of base layer 264 is in contact with the stepped major surface 202 of the stepped reverse crown roll 200.

Figure 2C:
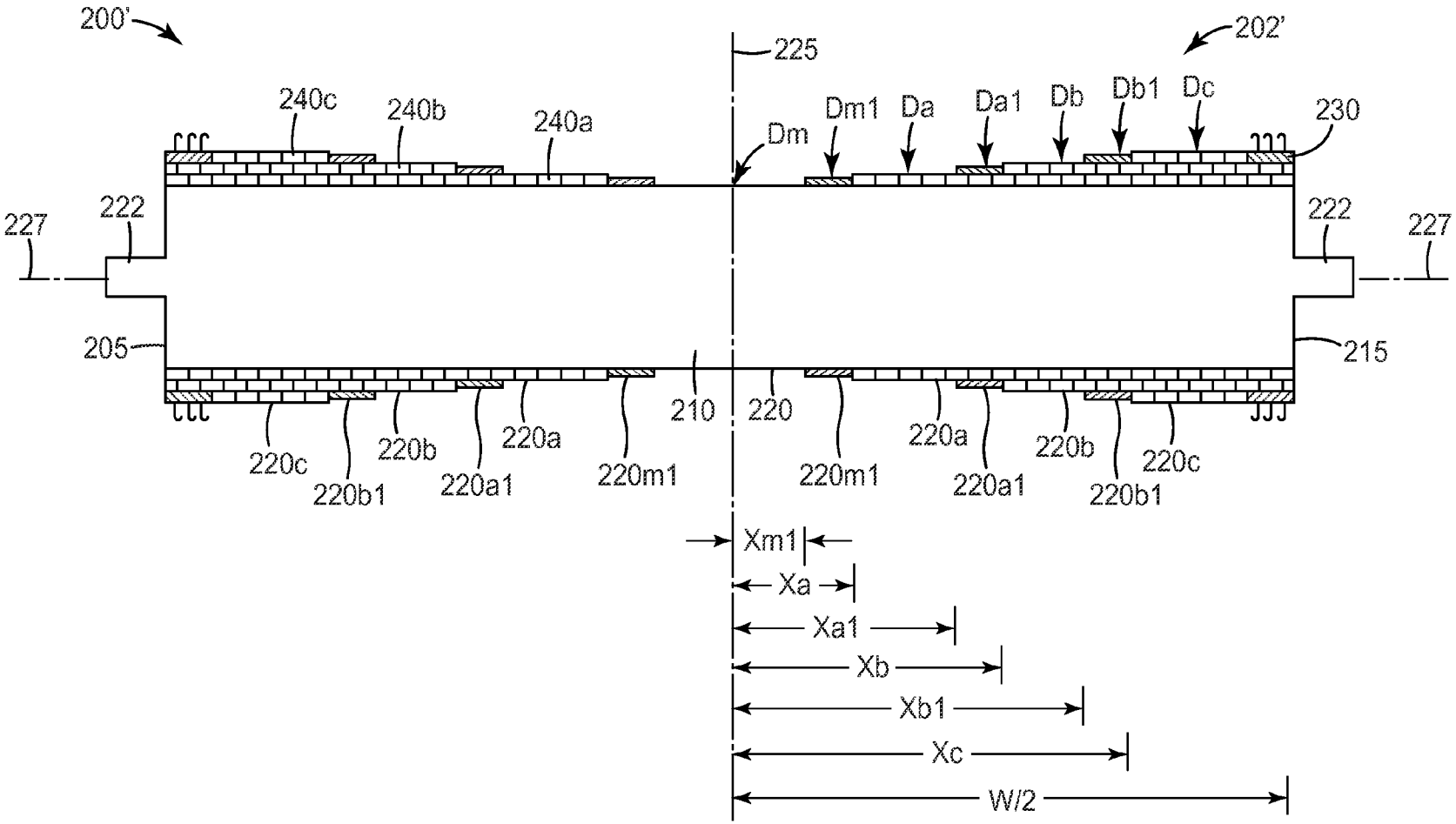
FIG. 2C shows a cross sectional view of a stepped reverse crown roll.

FIG. 2C shows a cross sectional view of a stepped reverse crown roll 200' that can be used as a spreader roll or a component of a spreader roll, according to one aspect of the invention. Stepped reverse crown roll 200' can be covered by disposing an engagement cover comprising a resilient engagement surface, over the stepped major surface 202' of the stepped reverse crown roll 200', in a manner similar to that shown in FIG. 2B. Each of the elements 205-230 shown in FIG. 2C correspond to like-numbered elements shown in FIG. 2A, which have been described previously. For example, central shaft 222 in FIG. 2C corresponds to central shaft 222 in FIG. 2A, and so on. In FIG. 2C, smaller step changes in the diameter can be made by applying successive second material layers adjacent the stepped major surface, wherein the second material layer has a thickness that is less than the thickness of the first material layer.

In one particular embodiment, a fourth layer **220*m*1, a fifth layer 220*a*1, and a sixth layer 220*b*1, are applied on top of the base major surface 220, the first layer 220*a*, and the second layer 220*b*, respectively. Each of the fourth, fifth, and sixth layers 220*m*1, 220*a*1, 220*b*1**, can comprise individual sections of second materials that can individually be selected from a tape, a sheet, a cord, a string, a wire, or the like, or a combination thereof. In one particular embodiment, a tape, such as an adhesive vinyl tape, can be preferred.

In one particular embodiment, each of the fourth, fifth, and sixth layers **220*m*1, 220*a*1, 220*b*1 can be spirally wound in a manner similar to the first, second, and third layers 220*a*, 220*b*, 220*c***, or can even comprise a sheet that is circumferentially wound as described elsewhere.

Fourth layer **220*m*1 extends from the fourth distance "Xm1" from the midpoint 225 to the first distance "Xa" from the midpoint 225, and results in a fourth stepped diameter "Dm1". Fifth layer 220*a*1 extends from a fifth distance "Xa1" from the midpoint 225 to the second distance "Xb" from the midpoint 225, and results in a fifth stepped diameter "Da1". Sixth layer 220*b*1 extends from a sixth distance "Xb1" from the midpoint 225 to the third distance "Xc" from the midpoint 225, and results in a sixth stepped diameter "Db1". In this manner, the stepped major surface 202' of stepped reverse crown roll 200' can more closely approximate the major surface 120 of the reverse crown roll 110 shown in FIG. 1A, by comprising the midpoint diameter "Dm", the fourth stepped diameter "Dm1", the first stepped diameter "Da", the fifth stepped diameter "Da1", the second stepped diameter "Db", the sixth stepped diameter "Db1**", and the third stepped diameter "Dc".

In some cases, the stepped reverse crown roll 200' can be symmetric about the midpoint 225, although in some cases, the roll may be asymmetric, and the stepped diameters may be different on each side of the midpoint, as known by one of skill in the art. The change in the stepped diameter is exaggerated in FIG. 2C; typical variations in the diameter over a half-width "W/2" may be about 0.001" per inch of roller width, such that for a 6 foot (183 cm) half-width roller, the taper may be about 0.07" (1.78 mm), although in some cases the variation may be more. In one particular embodiment, each material layer has a thickness between about 0.025 mm and about 0.25 mm. In one particular embodiment, the variation in the diameter may be greater when used with an engagement cover having a resilient engagement surface, as described elsewhere.

Each of the spreader rolls described herein can be used in a web conveying apparatus to reduce or eliminate sagging and bagging of a thin web during processing. Depending upon the embodiment, a web conveying apparatus may comprise one or more spreader rollers with engagement covers, and may further comprise one or more rollers not equipped with such engagement covers. Some embodiments will employ dozens or more rollers in sequence, with some, most, or even all of the rollers being equipped as spreader rollers with engagement covers. In embodiments of apparatuses comprising two or more spreader rollers equipped with engagement covers, the engagement covers may be selected to have different properties to optimize performance at different locations within the manufacturing sequence.

An advantage of the present invention is that typically engagement covers may be readily installed on existing spreader rollers without significant equipment change or significant reconfiguration of apparatus components. Thus, existing web conveying apparatuses may be readily refit with engagement covers of the invention to achieve attendant improvements in performance.

The manner in which the engagement cover is mounted on a spreader roller is dependent upon such factors as the configuration of the apparatus and rollers, for example, in some instances a roller must be removed from its operational location in order to have an engagement cover mounted thereon whereas in other instances the cover can be installed with the roll in operating position.

During operation, the engagement cover should not slide or stretch on the underlying roller as this can lead to wear of various components of the apparatus, damage to the web, or other impairment of performance. In many instances, when the engagement cover is simply a knit fabric as described herein and has a snug fit to the surface of the underlying roller, the second face of the engagement cover will remain firmly positioned on the roller during operation. In some instances, mounting means such as an intermediate adhesive, mated hook and loop fasteners, rigid shell which attaches to the roller, etc. will be used. In some instances, multiple engagement covers of the invention are installed on a single roller, mounted concentrically on the roller with the engagement surface of each orientated outward or away from the roller.

In preferred embodiments, the engagement cover is knit fabric as described in, for example, co-pending PCT Publication Nos. WO2011/038279 and WO2011/038284, and which can be mounted on the roller as a removable sleeve. The sleeve is preferably seamless and should be of appropriate size to fit around roller snugly without developing any loose bulges or ridges. In many embodiments, the sleeve will be configured to extend beyond both ends of the roller sufficiently far that it can be cinched and tied; if the sleeve is of appropriate dimension this action typically tends to pull the sleeve tight. Typically the sleeve should be at least as wide as the web, preferably wider than the web to ease concerns about alignment of the traveling web.

Mounting the engagement cover on the roller may be achieved by conventional means dependent in part upon the nature of the engagement cover and that of the conveying apparatus. Preferably the engagement cover does not slide on the roller core during operation. In many embodiments, the cover is in the form of a sleeve that fits snugly on the roller, optionally extending beyond the ends of the roller sufficiently to be cinched there. In some embodiments, the engagement cover and surface of the roller exhibit sufficient frictional effect, in some instances additional means such as adhesive or hook and loop type fastener mechanisms may be used.

While it is typically desirable for the base of a sleeve of the engagement cover to stretch so as to achieve a snug fit on the spreader roll, the base should not stretch during operation so as to cause bunching underneath the web being conveyed. Alternatively, rollers may be manufactured with engagement covers as described herein being more strongly attached to the outer surface thereof. Further, an advantage of removable embodiments is that it will typically be easier and cheaper to replace removable engagement covers on a roller to replace the engagement surface of rather than refinishing a roller having an integrated engagement surface in accordance with the disclosure.

In a typical embodiment, the cover is made with a knit fabric having a pile-forming loop at every stitch. In an illustrative embodiment there are 25 stitches per inch (1 stitch per millimeter). The fibrous material(s) used to make the fabric may be single filament strands, multifilament strands (for example, two or more strands wound together to yield a single thread), or combinations thereof.

In many embodiments, the looped pile has a loop height (that is, dimension from the plane defined by the top of the base layer to the apex of the pile loops) of from about 0.4 to about 0.8 mm, preferably from about 0.5 to about 0.7 mm. It will be understood that engagement covers having looped pile having loop heights outside this range may be used in certain embodiments. If the loop height is insufficient, the cover may fail to provide effective cushioning effect to the web to achieve the full benefits of the disclosure. If the loop height is too high, the pile may tend to get floppy and undesirably affect web transport or damage the conveyed web.

The pile should be sufficiently dense to be supportive of the web during conveying so as to reliably achieve the benefits of the disclosure. For instance, the looped pile comprises fibers selected to have an appropriate denier for the application, with thicker fibers providing relatively greater resistance to compression. Illustrative examples include fibers having a denier from about 100 to about 500. As will be understood, fibers having a denier outside this range may be used in some embodiments in accordance with the disclosure.

In illustrative embodiments, the fibrous material(s) can be selected from the group consisting of poly(tetrafluoroethylene) (PTFE such as, for example, TEFLON® fiber), aramid (for example, KEVLAR®), polyester, polypropylene, nylon, or combinations thereof. However, those skilled in the art will be able to readily select other fibers which can be effectively knit and used in covers of the disclosure.

The base is typically knit so as to provide the desired properties to permit it to be placed on a roller and used in accordance with the disclosure, for example, stretch and slide sufficiently easily over the roll to permit it to be installed while not stretching undesirably during operation.

Some illustrative examples of materials that can be used as sleeves to make engagement covers of the disclosure include: HS4-16 and HS6-23 polyester sleeves from Syfilco Ltd., Exeter, Ontario, Canada; WM-0401C, WM-0601, and WM-0801 polyester sleeves from Zodiac Fabrics Company, London, Ontario, Canada or its affiliate Carriff Corp., Midland, N.C.; and BBW3310TP-9.5 and BBW310TP-7.5 sleeves from Drum Filter Media, Inc., High Point, N.C.

Typically, knit fabrics are made using fibrous materials that have been treated with lubricants to facilitate the knitting process. When the resultant knit fabrics are used in web conveyance operations in accordance with the disclosure, such lubricants may tend to wear away causing variation in frictional performance to the web and potential contamination issues. Accordingly, it is typically preferred to wash or scour fabrics used as roller covering herein.

The material(s) selected should be compatible with the web materials and operating conditions, for example, stable and durable under the ambient operating conditions, for example, temperature, humidity, materials present, etc. It has been observed that, if the engagement cover material(s) are of contrasting color to the web materials, observation of debris capture by the engagement cover is facilitated, for example, using black polyester fibers in an engagement cover to be used with a transparent film web.

Typically, because of the requirements of the knitting processes used to make them, knit fabrics are made with fibrous materials that have limited elastomeric character so that the fibers can be moved around in contact with one another to form the desired knit. In many instances, lubricants are applied to the fibers to facilitate the knitting process. It is preferred to remove such lubricants from knits used in the present disclosure, for example, by cleaning or scouring the material such as by washing it before using it. In some instances, the knit can be put into service as an engagement surface of the disclosure with a lubricant being worn away.

Typically it is preferred that the loop pile of the engagement cover provide a coefficient of friction to the web of from about 0.25 to about 2, with about 1.0 or more often being preferred, though engagement covers providing coefficients of friction outside this range may be used if desired.

The degree of grip or coefficient of friction ("COF") which is desired of the engagement surface to the web is dependent in part upon the function of the subject roller. For instance, in the case of an idler roller or other roller operating under little tension differential, a lower COF is typically satisfactory. In the case of driven rollers, especially highly driven rollers operating under a large tension differential a higher COF is typically desired.

In some cases, in order to simultaneously achieve desired frictional properties with the web, abrasion resistance, radial modulus of elasticity, and resilience of the loop pile, quantities of selected polymeric relatively elastomeric (as compared to the fibrous pile material(s)) materials can be applied to the engagement surface to form grip enhancement elements that raise the effective COF between the engagement surface and web, if desired.

The described invention may be used with known web transport spreader rollers, including for example, rubber rollers, metal rollers (for example, aluminum, steel, tungsten, etc.), and composite rollers. Rollers may be solid or hollow and may include such apparatus to apply vacuum effects, heating the web, cooling the web, etc. Surprisingly, the spreader rollers having a resilient engagement cover can accommodate mismatches in placement of the web, for example, the centerline of the web may be displaced from the midpoint of the spreader roller and still provide spreading and smoothing of the web.

As noted above, in some instances, an apparatus may comprise rollers with multiple engagement covers installed thereon, mounted concentrically on a roller. This may be done to yield a thicker cushion depth, thus increasing the dampening effect of the engagement cover(s). Also, in some instance, particularly in large industrial settings, significantly more effort is required to install an engagement cover on a roller than is necessary to remove it from the roller. Thus, if multiple engagement covers are installed on a roller, once the outer one is contaminated and/or worn from use, the outer engagement cover can be removed to expose an underlying engagement cover for significantly less cost and effort than freshly installing a new cover.

The spreader rolls can be used in connection with a wide variety of web materials. It is well suited and can provide particular advantage in connection with the manufacture and handling of webs of high quality polymeric materials such as optical films. Such films, typically comprising one or more layers of select polymeric materials, for example, radiation-cured compositions, typically require precise and uniform specifications of width, thickness, film properties, etc. with very low defect rates. The web material may be of monolayer or multilayer construction.

In some embodiments, the web is a simple film, for example, of polyester (for example, photograde polyethylene terephthalate and MELINEX™ PET from DuPont Films) or polycarbonate. In some embodiments, the film comprises such materials as, for example, styrene-acrylonitrile, cellulose acetate butyrate, cellulose acetate propionate, cellulose triacetate, polyether sulfone, polymethyl methacrylate, polyurethane, polyester, polycarbonate, polyvinyl chloride, polystyrene, polyethylene naphthalate, copolymers or blends based on naphthalene dicarboxylic acids, polycyclo-olefins, and polyimides.

The engagement covers described herein have a low radial modulus of elasticity with enhanced tribological characteristics. As a result, the disclosure provides a convenient, low cost way to reduce undesirable effects on the web during web transport and handling.

The engagement covers provide a resilient low radial modulus of elasticity character to the roller surface which compensates for many pertubations encountered in a complex web transport system, for example, tension variations and speed variations, due to any of a myriad of causes, for example, variation in web properties such as thickness, modulus, etc., variations in performance or characteristics of individual rolls in a system comprising many rolls, power fluctuations in drive rolls, and the like. In accordance with the disclosure, the covers enable the web to avoid buckling and wrinkling when it otherwise might. In addition, the cover has been found to dampen velocity and tension variability of the web as it travels through the web line. As a result, high quality webs, for example, optical grade webs, can be processed at high speeds, for example, 100 fpm, 150 fpm, 170 fpm, or more, with reduced web degradation, for example, buckling, scuffing, etc. Furthermore, the pile construction is believed to entrap contamination, for example, dirt particles, that would otherwise damage the web being processed.

The spreader rolls described herein may be used on web transport apparatus having just one or two rolls, or systems having many more rolls. The engagement covers may be used on one or two selected spreader rolls in a system or in many, or even all, rolls throughout the system as desired.

EXAMPLES

Example 1

A general technique for producing a spreader roll as described herein began with a measurement of the length of the roll (either an ordinary cylindrical roll or an already existing reverse crown roll). The maximum and minimum web widths to be spread using the roll also were determined. Generally, 5 layers of tape were used to create the stepped reverse crown roll, and either layers were removed or added, depending on how much web spreading was needed. The amount of web spreading needed was determined by how the web was performing on the idler roll.

The average web width was determined, and 2 inches was subtracted from this. The result was then divided by ten, providing the spacing that was to be left in the middle of the roll, and also the approximate spacing between the subsequent layers of tape. The roll was then spiral wrapped from half the spacing distance from the center of the roll and to within an inch of the end of the roll. In many cases, the rolls were wide enough that an inch was left unwrapped for the attachment of 3M Scotchmate™ hook material, which was placed adjacent the ends. The second layer of tape was then wrapped over the first layer of tape beginning at the spacing distance previously determined. Attempts were made to straddle any gaps left between the spiral windings of the first layer of tape and make any spacing adjustments that were necessary to ensure relatively gap-free spiral windings. This procedure was repeated for the second, third, fourth and fifth layers, leaving an inch at the end of the roll. In some cases, the fifth layer was moved toward the center slightly to catch more of the edge of the web, if the majority of the webs to be processed were narrower than the average width. The wrapping process was then repeated on the other half of the roller. A tubular shaped resilient engagement surface material was cut to about 1.5 times the length of the roll and slid onto the roll. The hook material was then added to the one-inch spaces left at the ends of the roll. The hook material had an adhesive backing for attaching it to the roll. Then the tubular shaped resilient engagement surface was stretched and attached to the hook material on both ends and any excess material was trimmed off. The tubular shaped resilient engagement surface could be disengaged from the hook material and slid back across the roll to make any tape adjustments to the stepping deemed necessary to improve results.

The center 24" (61 cm) of a 144" (365.8 cm) roll that was 10.5" (26.7 cm) in diameter was left with no tape. The roll was spiral wrapped with 3M vinyl tape 471, which is 2" (5.1 cm) wide and ranged from 0.0035" to 0.005" (0.089 to 0.127 mm) thick. A first spirally wound layer of tape started 12" (30.5 cm) from the midpoint of the roll and extended out to within 2" (5.1 cm) of each end, in a manner similar to that shown in FIG. 2A. A second layer of tape was spirally wound over the first layer of tape and started 15" (38 cm) from the beginning of the first layer of tape (that is, 27" (69 cm) from the midpoint of the roll), and extended out to within 2" (5.1 cm) of the end. A third layer of tape was spirally wound over the second layer of tape and started 15" (38 cm) from the beginning of the second layer of tape (that is, 42" (107 cm) from the midpoint of the roll), and extended out to within 2" (5.1 cm) of the end. A fourth layer of tape was spirally wound over the third layer of tape and started 15" (38 cm) from the beginning of the third layer of tape (that is, 57" (144 cm) from the midpoint of the roll), and extended out to within 2" (5.1 cm) of the end. A final fifth layer of tape was spirally wound over the fourth layer of tape and started 10" (25.4 cm) from the beginning of the fourth layer of tape (that is, 67" (170 cm) from the midpoint of the roll), and extended out to within 2" (5.1 cm) of the end. Two rows of 3M Scotchmate™ Hook and Loop Reclosable Fastener material (hook portion only, 1" (2.54 cm) wide) were attached over the last two inches at the end of the roll, for later attachment of the resilient engagement surface. The previous steps were repeated for the other half of the roll.

Two concentric layers of tubular resilient engagement surface material were then placed over the roll. The first layer was hooked on the inner row of hook material and then trimmed to size, and the second layer was hooked on the outer row of hook material. The tubular resilient engagement surface material used to cover the roll was a 150 denier polyester for both the base layer and resilient loop pile, with a loop height of 1.5 mm.

Example 2

A commercially available reverse crown roll having 7.90" (20.07 cm) diameter cylindrical center section 38" (96.52 cm) wide and a 0.008" (0.203 mm) diametral reverse taper out to the ends (available from Webex, Neenah, Wis.) was mounted in a webline. A 57" wide polyester film 0.00114" (0.029 mm) in thickness was conveyed through the web line. The free web span (that is, the distance from the closest contact point) entering the reverse crown roll was 70 inches (178 cm) in length, and the free web span exiting the reverse crown roll was 40 inches (102 cm) in length. Web speed was 60 fpm (152 cm/min) with a web tension between 30 and 37 pounds measured on the winding station.

The web line was run with and without an engagement cover comprising a resilient engagement surface disposed over the major surface of the reverse crown roll. The resilient engagement surface was made from a resilient loop pile knitted material having polyester fiber with a 1.26 mm loop height and nylon 66 fiber with a 0.88 mm loop height. It was observed that there was better web spreading without the resilient engagement surface added to the reverse crown roll. We concluded that the resilient engagement surface masked the relatively small diametrical height variation of the purchased reverse crown roll, and reduced the web spreading ability of the reverse crown roll.

A stepped reverse crown roll was made from the commercially available reverse crown roll by adding (that is, "bumpering") spirally wound tape over the commercially available roll. Four total layers of tape were added, using techniques similar to those described in Example 1, to create the stepped reverse crown roll, which resulted in about 0.028" of diametral height variation from the center of the roll to the end. A row of 3M Scotchmate™ Hook and Loop Reclosable Fastener material (hook portion only) was attached over the end of the roll, for attachment of the same resilient engagement surface. The same web configuration was run as with the unbumpered reverse crown roll. Better web spreading was observed with the increased diametrical height variation of the stepped reverse crown roll.

Following are a list of embodiments of the present disclosure.

Item 1 is a spreader roll, comprising: a reverse crown roll having a major surface, two ends, a midpoint halfway between the two ends, and a variable diameter that decreases from a first end diameter to a midpoint diameter, and increases from the midpoint diameter to a second end diameter; and an engagement cover comprising a resilient engagement surface, the engagement cover disposed over the major surface of the reverse crown roll.

Item 2 is the spreader roll of item 1, wherein the major surface is a stepped major surface, and the variable diameter decreases stepwise from the first end diameter to the midpoint and increases stepwise from the midpoint to the second end diameter.

Item 3 is the spreader roll of item 1 or item 2, wherein the major surface is a stepped major surface comprising successive material layers of a tape, a sheet, a cord, a string, a wire, or a combination thereof.

Item 4 is the spreader roll of item 3, wherein the material layers are sequentially applied to a base roll surface.

Item 5 is the spreader roll of item 4, wherein the base roll surface includes a uniform diameter.

Item 6 is the spreader roll of item 3 to item 5, wherein each material layer has a first thickness between about 0.025 mm and about 0.25 mm.

Item 7 is the spreader roll of item 3 to item 6, further comprising a second material layer disposed adjacent the stepped major surface, the second material layer having a second thickness that is less than a first material thickness.

Item 8 is the spreader roll of item 3 to item 7, wherein each material layer comprises a spirally wound tape around the base roll surface.

Item 9 is the spreader roll of item 3 to item 8, wherein each material layer comprises a sheet that is circumferentially wound around the base roll surface.

Item 10 is the spreader roll of item 8, wherein adjacent spirally wound tape layers abut each other.

Item 11 is the spreader roll of item 3 to item 10, wherein a first material layer is applied on a uniform diameter base roll surface, extending from a first distance from the midpoint to a first end, and also extending in an opposite direction from a second distance from the midpoint to a second end.

Item 12 is the spreader roll of item 11, wherein each subsequent material layer is applied extending from a subsequent layer distance from the midpoint to the respective end, wherein the subsequent layer distance is greater than an underlying layer distance from the midpoint.

Item 13 is the spreader roll of item 1 to item 12, wherein the resilient engagement surface comprises a resilient looped pile, an open cell foam, a closed cell foam, or a combination thereof.

Item 14 is the spreader roll of item 1 to item 13, wherein the resilient engagement surface is a knit fabric comprising a base layer having first and second faces and a resilient looped pile protruding from the first face.

Item 15 is the spreader roll of item 14, wherein the base layer comprises a woven base layer, a knitted base layer, a non-woven base layer, or a combination thereof.

Item 16 is the spreader roll of item 1 to item 15, wherein the engagement cover attaches to the major surface of the reverse crown roll by compression, adhesion, mechanical attachment, or a combination thereof.

Item 17 is the spreader roll of item 1 to item 16, wherein the engagement cover comprises a tube shape or a rectangle shape.

Item 18 is the spreader roll of item 1 to item 17, wherein the resilient looped pile comprises a fibrous material selected from poly(tetrafluoroethylene), aramid, polyester, polypropylene, nylon, or a combination thereof.

Item 19 is the spreader roll of item 1 to item 18, wherein the spreader roll comprises at least two engagement covers concentrically disposed over the major surface of the reverse crown roll.

Item 20 is a spreader roll, comprising: a reverse crown roll comprising: a roller having an outer surface, a first end and a second end, a midpoint having a midpoint diameter midway between the first end and the second end, and a variable outer diameter; a first material layer attached to the outer surface and extending in opposing directions from a first distance from the midpoint to the first end and from a second distance from the midpoint to the second end; a second material layer attached to the first material layer and extending in opposing directions from a third distance from the midpoint to the first end, and from a fourth distance from the midpoint to the second end, wherein the third distance is greater than the first distance, and the fourth distance is greater than the second distance; and an engagement cover comprising a resilient engagement surface, the engagement cover disposed over the outer surface, the first material layer, and the second material layer.

Item 21 is the spreader roll of item 20, wherein the first distance and the second distance are approximately equal, and the third distance and the fourth distance are approximately equal.

Item 22 is the spreader roll of item 20 or item 21, wherein the first material layer and the second material layer each comprise a tape, a sheet, a cord, a string, a wire, or a combination thereof.

Item 23 is the spreader roll of item 20 to item 22, wherein each material layer has a first thickness between about 0.025 mm and about 0.25 mm.

Item 24 is the spreader roll of item 20 to item 23, wherein each material layer comprises a tape that is spirally wound around the outer surface.

Item 25 is the spreader roll of item 20 to item 24, wherein each material layer comprises a sheet that is circumferentially wound around the outer surface.

Item 26 is the spreader roll of item 24, wherein adjacent spirally wound tape layers abut each other.

Item 27 is the spreader roll of item 20 to item 26, wherein subsequent material layers are applied extending from a subsequent layer distance from the midpoint to the respective end, wherein the subsequent layer distance is greater than an underlying layer distance from the midpoint.

Item 28 is the spreader roll of item 20 to item 27, wherein the resilient engagement surface comprises a resilient looped pile, an open cell foam, a closed cell foam, or a combination thereof.

Item 29 is the spreader roll of item 20 to item 28, wherein the resilient engagement surface is a knit fabric comprising a base layer having first and second faces and a resilient looped pile protruding from the first face.

Item 30 is the spreader roll of item 29, wherein the base layer comprises a woven base layer, a knitted base layer, a non-woven base layer, or a combination thereof.

Item 31 is the spreader roll of item 20 to item 30, wherein the engagement cover attaches to the outer surface of the reverse crown roll by compression, adhesion, mechanical attachment, or a combination thereof.

Item 32 is the spreader roll of item 20 to item 31, wherein the engagement cover comprises a tube shape or a rectangle shape.

Item 33 is the spreader roll of item 20 to item 32, wherein the resilient looped pile comprises a fibrous material selected from poly(tetrafluoroethylene), aramid, polyester, polypropylene, nylon, or a combination thereof.

Item 34 is the spreader roll of item 20 to item 33, wherein the spreader roll comprises at least two engagement covers concentrically disposed over the outer surface of the reverse crown roll.

Item 35 is an apparatus for spreading a web, comprising: a spreader roll according to item 1 to item 34, capable of rotating around an axis of rotation; wherein the spreader roll is capable of spreading a web material in a cross-web direction essentially parallel to the axis of rotation while conveying the web material in a downweb direction perpendicular to the spreader roll axis of rotation.

Item 36 is the apparatus of item 35, wherein the web material has a center that can be offset from the spreader roll midpoint by an offset distance.

Item 37 is the apparatus of item 36, wherein the offset distance can include any distance from the spreader roll midpoint where the variable diameter is equal to the midpoint diameter.

Item 38 is a method for spreading a web, comprising: providing a spreader roll according to item 1 to item 34, capable of rotating around an axis of rotation; providing a web material; conveying the web material in a downweb direction perpendicular to the axis of rotation; and contacting the moving web material with the resilient engagement surface of the rotatable spreader roll, thereby spreading the web material in a crossweb direction essentially parallel to the axis of rotation.

Unless otherwise indicated, all numbers expressing feature sizes, amounts, and physical properties used in the specification and claims are to be understood as being modified by the term "about". Accordingly, unless indicated to the contrary, the numerical parameters set forth in the foregoing specification and attached claims are approximations that can vary depending upon the desired properties sought to be obtained by those skilled in the art utilizing the teachings disclosed herein.

All references and publications cited herein are expressly incorporated herein by reference in their entirety into this disclosure, except to the extent they may directly contradict this disclosure. Although specific embodiments have been illustrated and described herein, it will be appreciated by those of ordinary skill in the art that a variety of alternate and/or equivalent implementations can be substituted for the specific embodiments shown and described without departing from the scope of the present disclosure. This application is intended to cover any adaptations or variations of the specific embodiments discussed herein. Therefore, it is intended that this disclosure be limited only by the claims and the equivalents thereof.

What is claimed is:

1. A spreader roll, comprising:

a reverse crown roll having a major surface, two ends, a midpoint halfway between the two ends, and a variable diameter that decreases from a first end diameter to a midpoint diameter, and increases from the midpoint diameter to a second end diameter, wherein the major surface is a stepped major surface comprising successive material layers spirally wound around the major surface of a base roll having a major surface wherein each subsequent material layer is applied extending from a subsequent layer distance from the midpoint to the respective end, wherein the subsequent layer distance from the midpoint is greater than an underlying layer distance from the midpoint; and an engagement cover comprising a resilient engagement surface, the engagement cover disposed over the major surface of the reverse crown roll.

2. The spreader roll of claim 1, wherein the variable diameter decreases stepwise from the first end diameter to the midpoint and increases stepwise from the midpoint to the second end diameter.

3. The spreader roll of claim 1, wherein the material layers comprise a tape, a sheet, a cord, a string, a wire, or a combination thereof.

4. The spreader roll of claim 1, wherein the material layers are sequentially applied to the major surface of the base roll.

5. The spreader roll of claim 1, wherein the base roll is cylindrical, the major surface of the base roll having a uniform diameter.

6. The spreader roll of claim 4, wherein a first material layer is applied on the uniform diameter base roll major surface, extending from a first distance from the midpoint to a first end, and also extending in an opposite direction from a second distance from the midpoint to a second end.

7. The spreader roll of claim 1, wherein each material layer has a first thickness between about 0.025 mm and about 0.25 mm.

8. The spreader roll of claim 1, further comprising a second material layer disposed adjacent the stepped major surface, the second material layer having a second thickness that is less than a first material thickness.

9. The spreader roll of claim 1, wherein the material layers comprise a sheet that is circumferentially wound around the base roll major surface.

10. The spreader roll of claim 1, wherein adjacent material layers abut each other.

11. The spreader roll of claim 1, wherein the resilient engagement surface comprises a resilient looped pile, an open cell foam, a closed cell foam, or a combination thereof.

12. The spreader roll of claim 11, wherein the resilient looped pile comprises a fibrous material selected from poly(tetrafluoroethylene), aramid, polyester, polypropylene, nylon, or a combination thereof.

13. The spreader roll of claim 1, wherein the resilient engagement surface is a knit fabric comprising a base layer having first and second faces and a resilient looped pile protruding from the first face.

14. The spreader roll of claim 13, wherein the base layer comprises a woven base layer, a knitted base layer, a non-woven base layer, or a combination thereof.

15. The spreader roll of claim 1, wherein the engagement cover attaches to the major surface of the reverse crown roll by compression, adhesion, mechanical attachment, or a combination thereof.

16. The spreader roll of claim 1, wherein the engagement cover comprises a tube shape or a rectangle shape.

17. The spreader roll of claim 1, wherein the spreader roll comprises at least two engagement covers concentrically disposed over the major surface of the reverse crown roll.

18. A spreader roll, comprising:

a reverse crown roll comprising:

a roller having an outer surface, a first end and a second end, a midpoint having a midpoint diameter midway between the first end and the second end, and a variable outer diameter;

a first material layer attached to the outer surface and extending in opposing directions from a first distance from the midpoint to the first end and from a second distance from the midpoint to the second end;

a second material layer attached to the first material layer and extending in opposing directions from a third distance from the midpoint to the first end, and from a fourth distance from the midpoint to the second end, wherein the third distance from the midpoint is greater than the first distance from the midpoint, and the fourth distance from the midpoint is greater than the second distance from the midpoint; and an engagement cover comprising a resilient engagement surface, the engagement cover disposed over the outer surface, the first material layer, and the second material layer.

19. The spreader roll of claim 18, wherein the first distance and the second distance are approximately equal, and the third distance and the fourth distance are approximately equal.

20. The spreader roll of claim 18, wherein the first material layer and the second material layer each comprise a tape, a sheet, a cord, a string, a wire, or a combination thereof.

21. The spreader roll of claim 18, wherein each material layer has a first thickness between about 0.025 mm and about 0.25 mm.

22. The spreader roll of claim 18, wherein each material layer comprises a tape that is spirally wound around the outer surface.

23. The spreader roll of claim 18, wherein each material layer comprises a sheet that is circumferentially wound around the outer surface.

24. The spreader roll of claim 22, wherein adjacent spirally wound tape layers abut each other.

25. The spreader roll of claim 18, further comprising one or more subsequent material layers, wherein the subsequent material layers are applied extending from a subsequent layer distance from the midpoint to the respective end.

26. The spreader roll of claim 18, wherein the resilient engagement surface comprises a resilient looped pile, an open cell foam, a closed cell foam, or a combination thereof.

27. The spreader roll of claim 26, wherein the resilient looped pile comprises a fibrous material selected from poly(tetrafluoroethylene), aramid, polyester, polypropylene, nylon, or a combination thereof.

28. The spreader roll of claim 18, wherein the resilient engagement surface is a knit fabric comprising a base layer having first and second faces and a resilient looped pile protruding from the first face.

29. The spreader roll of claim 28, wherein the base layer comprises a woven base layer, a knitted base layer, a non-woven base layer, or a combination thereof.

30. The spreader roll of claim 18, wherein the engagement cover attaches to the outer surface of the reverse crown roll by compression, adhesion, mechanical attachment, or a combination thereof.

31. The spreader roll of claim 18, wherein the engagement cover comprises a tube shape or a rectangle shape.

32. The spreader roll of claim 18, wherein the spreader roll comprises at least two engagement covers concentrically disposed over the outer surface of the reverse crown roll.

33. An apparatus for spreading a web, comprising:

a spreader roll according to claim 1 or claim 18, capable of rotating around an axis of rotation;

wherein the spreader roll is capable of spreading a web material in a cross-web direction essentially parallel to the axis of rotation while conveying the web material in a downweb direction perpendicular to the spreader roll axis of rotation.

34. The apparatus of claim 33, wherein the web material has a center that can be offset from the spreader roll midpoint by an offset distance.

35. The apparatus of claim 34, wherein the offset distance can include any distance from the spreader roll midpoint where the variable diameter is equal to the midpoint diameter.

36. A method for spreading a web, comprising:

providing a spreader roll according to claim 1 or claim 18, capable of rotating around an axis of rotation;

providing a web material;

conveying the web material in a downweb direction perpendicular to the axis of rotation; and contacting the moving web material with the resilient engagement surface of the rotatable spreader roll, thereby spreading the web material in a crossweb direction essentially parallel to the axis of rotation.

* * * * *